US007725051B2

(12) United States Patent
Lee

(10) Patent No.: US 7,725,051 B2
(45) Date of Patent: May 25, 2010

(54) CARTRIDGE, IMAGE FORMING APPARATUS, AND METHOD FOR MOUNTING AND DISMOUNTING THE CARTRIDGE IN AND FROM A MAIN BODY OF THE IMAGE FORMING APPARATUS

(75) Inventor: Su-in Lee, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 175 days.

(21) Appl. No.: 11/471,573

(22) Filed: Jun. 21, 2006

(65) Prior Publication Data

US 2007/0071496 A1 Mar. 29, 2007

(30) Foreign Application Priority Data

Sep. 26, 2005 (KR) ..... 10-2005-0089466

(51) Int. Cl.
*G03G 15/00* (2006.01)

(52) U.S. Cl. ..... 399/111; 399/113; 399/114; 399/125

(58) Field of Classification Search ..... 399/111, 399/113, 114, 125
See application file for complete search history.

(56) References Cited

U.S. PATENT DOCUMENTS

| | | | | |
|---|---|---|---|---|
| 5,083,158 | A * | 1/1992 | Kashima et al. | 399/114 |
| 5,589,918 | A * | 12/1996 | Oshida et al. | 399/114 |
| 5,839,028 | A * | 11/1998 | Nomura et al. | 399/109 |
| 5,920,753 | A * | 7/1999 | Sasaki et al. | 399/111 |
| 6,405,004 | B2 * | 6/2002 | Matsuzaki et al. | 399/111 |
| 7,103,300 | B2 * | 9/2006 | Kim et al. | 399/111 |
| 7,155,141 | B2 * | 12/2006 | Sato et al. | 399/114 |
| 7,298,989 | B2 * | 11/2007 | Nishimura | 399/111 |
| 7,319,832 | B2 * | 1/2008 | Nishimura et al. | 399/111 |
| 7,327,970 | B2 * | 2/2008 | Moon | 399/111 |
| 7,424,243 | B2 * | 9/2008 | Kweon | 399/107 |
| 2002/0076235 | A1 * | 6/2002 | Matsuzaki | 399/111 |
| 2004/0234293 | A1 * | 11/2004 | Karakama et al. | 399/111 |
| 2005/0147429 | A1 * | 7/2005 | Kim et al. | 399/111 |

FOREIGN PATENT DOCUMENTS

| | | |
|---|---|---|
| EP | 0 622 700 | 11/1994 |
| EP | 1 115 039 | 7/2001 |
| JP | 63-45556 | 3/1988 |
| JP | 5-303242 | 11/1993 |
| KR | 1999-0028899 | 7/1999 |
| KR | 2001-255806 | 9/2001 |

* cited by examiner

*Primary Examiner*—David M Gray
*Assistant Examiner*—G. M. Hyder
(74) *Attorney, Agent, or Firm*—Roylance, Abrams, Berdo & Goodman, L.L.P.

(57) ABSTRACT

A process cartridge, an image forming apparatus having the cartridge, and a method for mounting and dismounting the process cartridge in and from an image forming apparatus body are provided. The process cartridge includes at least one photosensitive body on which an electrostatic latent image is formed, and a developing member for developing the electrostatic latent image, and a housing receiving and supporting at least one photosensitive body and the developing member. The housing includes first and second guide outwardly extending protrusions on a first surface and a second opposite surface of the housing in order to position the process cartridge in the image forming apparatus body, and a mount and dismount supporting part formed on a third surface to rotate the housing to mount and dismount the process cartridge from the image forming apparatus body.

23 Claims, 10 Drawing Sheets

CARTRIDGE, IMAGE FORMING APPARATUS, AND METHOD FOR MOUNTING AND DISMOUNTING THE CARTRIDGE IN AND FROM A MAIN BODY OF THE IMAGE FORMING APPARATUS

CROSS-REFERENCE TO RELATED APPLICATION

This application claims benefit under 35 U.S.C. §119 (a) of Korean Patent Application No. 2005-89466, filed on Sep. 26, 2005, the entire content of which is incorporated herein by reference.

BACKGROUND OF THE INVENTION

1. Field of the Invention

The present invention relates to an image forming apparatus such as a laser printer, a digital copier, and a facsimile. More particularly, the present invention relates to a process cartridge, an image forming apparatus incorporating the cartridge, and a method for mounting and dismounting the process cartridge in and from an image forming apparatus body.

2. Description of the Related Art

Generally, an electrophotographic image forming apparatus such as a laser printer, a digital copier, and a facsimile comprises a process cartridge including a developing unit or integrating a photosensitive body unit and a developing unit into a single module. A photosensitive body of the photosensitive body unit is exposed to a laser to form an electrostatic latent image thereon. The developing unit supplies developer to the photosensitive body to form a developer image corresponding to the electrostatic latent image.

Generally, the process cartridge is detachably mounted in an image forming apparatus body to easily repair or replace all parts of the cartridge.

FIGS. 1, 2A and 2B are views of a general process cartridge 1 in which the photosensitive body unit and the developing unit are integrated into a single module.

The process cartridge 1 comprises a photosensitive body casing 2 and a developing casing 8.

In the photosensitive body casing 2, a photosensitive body unit is formed which comprises a photosensitive body 7 having a drumlike configuration, a charging roller 8 for charging a surface of the photosensitive body 7, and a cleaning member (not shown) such as a cleaning roller and a cleaning blade for cleaning the photosensitive body 7.

On an upper portion of the photosensitive body casing 2, a knob 6 is provided to carry and move the process cartridge 1.

A first and a second side members 14*a*, 14*b* are provided on the opposite end portions of the photosensitive body casing 2.

On the first and the second side members 14*a*, 14*b* are formed a first and a second guide protrusions 24 (only the first guide protrusion is shown) protruding to the outside to be coaxially aligned with an axis of the photosensitive body 7. A third and a fourth guide protrusions 25 (only the third protrusion is shown) protrude outwardly from the side members a certain distance from the first and the second guide protrusions 24.

As the process cartridge 1 is mounted in the image forming apparatus body, the first and the second guide protrusions 24 are guided along a first and a second guide recess 20*a* (only the first guide recess is shown) of a first and a second guide member 20 so as to be received in a receiving recess 20*b* of the first and the second guide recesses 20*a*. The first and the second guide protrusions 24 each are received in the receiving recess 20*b* so as to position the process cartridge 1 in a mounting position.

As the process cartridge 1 is mounted in the image forming apparatus body 1, the third and the fourth guide protrusions 25 are received in the first and the second guide recesses 20*a*. As the process cartridge 1 is mounted and dismounted in or from the image forming apparatus body, the third and the fourth guide protrusions 25 guide the movement of the process cartridge 1 and operate as a hinge point supporting the rotation of the process cartridge 1 in the first and the second guide recesses 20*a*.

Accordingly, as the process cartridge 1 is mounted in the image forming apparatus and then, pulled or pushed in first and second directions P1, P2 by the knob 6, the process cartridge 1 is minutely rotated in the direction of arrow a, b based on the third and the fourth guide protrusions 25 as a hinge point. As a result, the first and the second guide protrusions 24 are received in the receiving recess 20*b* or separated from the receiving recess 20*b* of the first and the second guide recesses 20*a*.

The developing casing 8 may be formed integrally with or detachably from the photosensitive body casing 2.

The developing casing 8 comprises a developing roller 10 contacting the photosensitive body 7 with a certain gap, a supply roller (not shown) supplying the developing roller 10 with developer, and a developer regulating blade (not shown) contacting the developing roller 10 to regulate the thickness of the developing layer.

The process of mounting and dismounting the process cartridge 1 in or from the image forming apparatus body for replacing or repairing the process cartridge 1 will be explained below.

To dismount the process cartridge 1 from the image forming apparatus body, the image forming apparatus body cover (not shown) is opened and the process cartridge 1 is pulled in the first direction P1 by the knob 6.

As a result, the process cartridge 1 rotated in the direction of arrow b using the third and the fourth guide protrusions 25 as a hinge point, as shown in FIG. 2B so that the first and the second guide protrusions 24 are moved upwardly and separated from the receiving recess 20*b* of the first and the second guide recesses 20*a*.

Then, as the process cartridge 1 is pulled further in the first direction P1 by the knob 6, the four guide protrusions 24, 25 slide along the first and the second guide recesses 20*a* and are separated from the first and the second guide recesses 20*a*.

Then, the process cartridge 1 is lifted upwardly and pulled out through the process cartridge body cover to the outside.

After the process cartridge 1 is pulled out of the image forming apparatus body to the outside, the process cartridge 1 is disassembled to repair problematic parts thereof or replaced with new one, if necessary.

After completing the repairing or replacing, the repaired or replaced process cartridge 1 is put through the image forming apparatus body cover into the image forming apparatus body to be mounted therein.

After fitting the first and the second guide protrusions 24 in the first and the second guide recesses 20*a*, the process cartridge 1 is pushed in the second direction P2 by the knob 6.

As the process cartridge 1 is nearly mounted in the image forming apparatus body, the third and the fourth guide protrusions 25 fit in the first and the second guide recesses 20*a* and then, the process cartridge 1 is pushed further in the second direction P2 by the knob 6. Therefore, the first and the second guide protrusions 24 contact with an end portion wall 20*c* of the first and the second guide recesses 20*a* as shown in FIG. 2B.

The process cartridge 1 is minutely rotated in the direction of arrow a using the third and the fourth guide protrusions 25 as a hinge point by inertial force and its own weight. Therefore, the first and the second guide protrusions 24 are inserted and received in the receiving recess 20*b* of the first and the second guide recesses 20*a*, as shown in FIG. 2A. Additionally, a photosensitive body gear 7*a* of one end portion of the photosensitive body 7 is meshed with a driving gear 21, transmitting a driving force of a driving motor, of a main gear train of the image forming apparatus body.

However, as the conventional process cartridge 1 with the above structure is mounted in the image forming apparatus body, the four guide protrusions 24, 25 of the first and the second side members 14*a*, 14*b* should be simultaneously inserted into the first and the second guide recesses 20*a* of the first and the second guide members 20. Accordingly, careful operations are required to accurately insert the four guide protrusions 24, 25 into the first and the second guide recesses 20*a* when the first and the second guide protrusions 24 are inserted in the first and the second guide recesses 20*a* and when the third and the fourth guide protrusions 25 are inserted into the first and the second guide recesses 20*a* after the first and the second guide protrusions 24 are inserted in the first and the second guide recesses 20*a*. Additionally, in order to completely fit the first and the second guide protrusions 24 in the receiving recess 20*b* of the first and the second guide recesses 20*a*, the process cartridge 1 should be continuously pushed in the second direction P2 by the knob 6 so as not to be freely moved.

Further, as the conventional process cartridge 1 is dismounted from the image forming apparatus body, the first through the fourth guide protrusions 24, 25 should be completely separated from the first and the second guide recesses 20*a* of the first and the second guide members 20 to pull the process cartridge 1 out of the image forming apparatus body 1 to the outside. Accordingly, as the process cartridge 1 is dismounted and mounted in or from the image forming apparatus body, the time required to remove the process cartridge 1 from the image forming apparatus body is delayed by the length of the first and the second guide recesses 20*a*. Additionally, if the process cartridge 1 is pulled out by force, the first and the second guide protrusions 24 and/or the third and the fourth guide protrusions 25 may be damaged.

SUMMARY OF THE INVENTION

Accordingly, the aspects of the present invention are to solve at least the above problem and/or disadvantages and to provide at least the advantages described below. Therefore, an object of the present invention is to provide a process cartridge that has a relatively simple construction to be easily mounted and dismounted in or from an image forming apparatus body, an image forming apparatus having the same, and a method for mounting and dismounting the process cartridge in or from the image forming apparatus body.

Another object of the present invention is to provide a process cartridge that includes a mount and dismount supporting part, which has the most effective moment in a knob, so as to easily and effectively be mounted and dismounted in or from an image forming apparatus body by the knob. The invention is also directed to an image forming apparatus having the process cartridge. The invention is also directed to a method for mounting and dismounting the process cartridge in or from the image forming apparatus body.

To achieve the above-described objects, a process cartridge of an image forming apparatus is provided, which can be detachably mounted in an image forming apparatus body. The process cartridge comprises at least one of a photosensitive body on which an electrostatic latent image is formed, and a developing member for developing the electrostatic latent image, and a housing receiving and supporting the at least one of the photosensitive body and the developing member. The housing comprises a first and a second guide protrusion protruding from a first surface and a second surface opposite the first surface of the housing and extending outwardly to position in a mounting position of the housing as the process cartridge is mounted in the image forming apparatus body, and a mount and dismount supporting part formed on a third surface, perpendicular to the first and the second surfaces of the housing to rotate the housing as the process cartridge is mounted in or dismounted from the image forming apparatus body.

The first and the second guide protrusions may be coaxially formed with an axis of the photosensitive body and/or the developing member.

The mount and dismount supporting part may comprise at least one hinge recess formed on the third surface adjacent to an edge of at least one of the first and the second surfaces. The at least one hinge recess comprises a first and a second hinge recess formed at a lower portion surface of a first and a second side plates of opposite ends of the housing and includes an inclined recess surface and a horizontal recess surface.

The housing may further comprise a knob formed above a line connecting the first or the second guide protrusion and the mount and dismount supporting part.

The housing may further comprise at least one of a third and a fourth guide protrusion protruding outward from the first and the second surfaces a certain distance from the first and the second guide protrusions in order to guide movement of the housing as the process cartridge is mounted in or dismounted from the image forming apparatus body.

To achieve the above-described object, an image forming apparatus is provided which comprises a process cartridge including at least one of a photosensitive body on which an electrostatic latent image is formed, and a developing member for developing the electrostatic latent image, and a housing receiving and supporting the at least one of the photosensitive body and the developing member, and a main body frame including a cartridge mount part having first and second guide rails with an opened top portion to mount the process cartridge, and a main body mount and dismount supporting part for rotating the process cartridge as the process cartridge is mounted in or dismounted from the image forming apparatus, wherein the housing comprises first and second guide protrusions protruding outwardly from a first surface and a second surface opposite the first surface of the housing and being guided along the first and the second guide rails in order to position a mounting position of the housing as the process cartridge is mounted in the image forming apparatus body, and a cartridge mount and dismount supporting part formed on a third surface, perpendicular to the first and the second surfaces, of the housing to correspond to the main body mount and dismount supporting part in order to rotate the housing in cooperation with the main body mount and dismount supporting part as the process cartridge is mounted in or dismounted from the image forming apparatus body.

The first and the second guide rails may comprise a receiving recess receiving the first and the second guide protrusions.

The first and the second guide protrusions may be coaxially formed with an axis of one of the photosensitive body and the developing member.

The cartridge mount and dismount supporting part may comprise at least one hinge recess formed on the third surface adjacent an edge of at least one of the first and the second surfaces, and the main body mount and dismount supporting part may comprise at least one hinge protrusion formed at the main body frame to correspond to the hinge recess. The at least one hinge recess may comprise a first and a second hinge recesses formed at a lower portion surface of first and second side plates on opposite ends of the housing and include an inclined recess surface and a horizontal recess surface, and the at least one hinge protrusion may comprise a first and a second hinge protrusions which are formed at the main body frame under the first and the second guide rails and include an inclined surface not contacting with the housing as the process cartridge is mounted in or dismounted from the image forming apparatus and a horizontal surface to mesh with the horizontal recess surface of the second hinge recess.

The housing may further comprise a knob formed above a line connecting the first or the second guide protrusion and the cartridge mount and dismount supporting part.

The housing may further comprise at least one of a third and a fourth guide protrusions protruding from the first and the second surfaces to the outside with a certain distance from the first and the second guide protrusions in order to guide the movement of the housing along the first and the second guide rails as the process cartridge is mounted in or dismounted from the image forming apparatus body.

To achieve the above-described object, a method for mounting and dismounting a process cartridge in and from an image forming apparatus comprises grasping a knob of the process cartridge, rotating the process cartridge around a hinge point of a cartridge mount and dismount supporting part formed on a lower surface of the process cartridge by pulling the knob, and pulling out the process cartridge outwardly.

The step of rotating the process cartridge may comprise rotating the process cartridge by supporting the cartridge mount and dismount supporting part on a main body mount and dismount supporting part of a main body frame, and separating first and second guide protrusions of opposite ends on the process cartridge from receiving recesses of first and second guide rails of the cartridge mount part of the main body frame. The main body mount and dismount supporting part may comprise at least one hinge protrusion formed on the main body frame, and the cartridge mount and dismount supporting part may comprise at least one hinge recess formed on a lower portion of the process cartridge corresponding to the hinge protrusion.

The step of pulling out the process cartridge outwardly may further comprise lifting the process cartridge to separate the first and the second guide protrusions of the process cartridge from the first and the second guide rails.

The method may further comprise locating the process cartridge on a cartridge mount part of the main body frame, sliding the process cartridge along the cartridge mount part, and supporting the cartridge mount and dismount supporting part of the process cartridge by the main body mount and dismount supporting part of the main body frame.

The step of locating the process cartridge on the cartridge mount part may comprise locating first and second guide protrusions on opposite ends of the process cartridge on first and second guide rails, corresponding to the first and the second guide protrusions of the cartridge mount part of the main body frame.

The step of sliding the process cartridge may comprise sliding the first and the second guide protrusions along the first and the second guide rails.

The step of supporting the cartridge mount and dismount supporting part by the main body mount and dismount supporting part may comprise fitting first and second hinge recesses of the cartridge mount and dismount supporting part of a lower portion surface of the process cartridge over first and second hinge protrusions, corresponding to the first and the second hinge recesses of the main body mount and dismount part of the main body frame.

The method may further comprise fitting the first and the second guide protrusions in a receiving recess of the first and the second guide rails.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
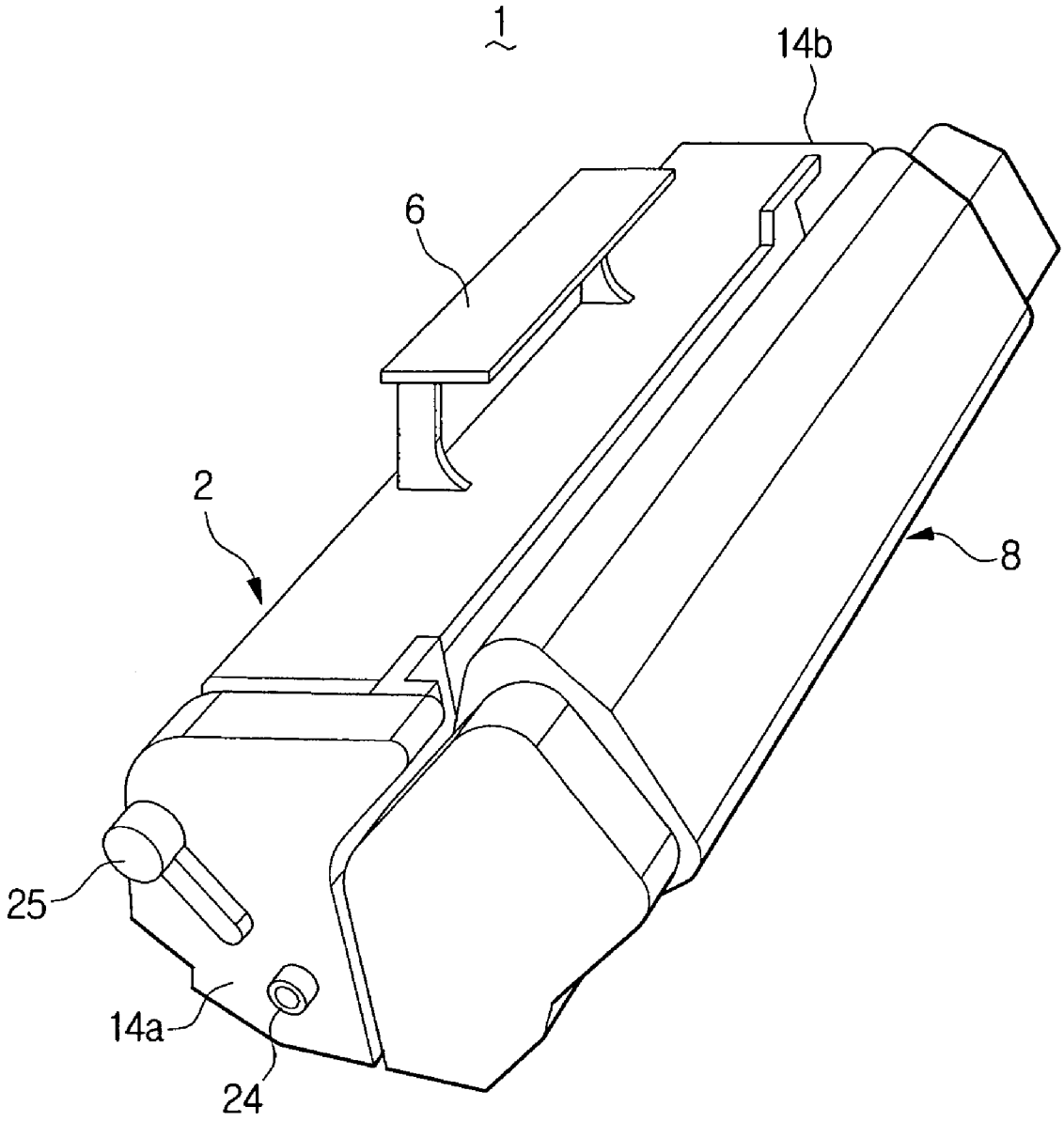
FIG. 1 (PRIOR ART)
FIG. 1 is a perspective view of a conventional process cartridge of an image forming apparatus.
Figure 2A:
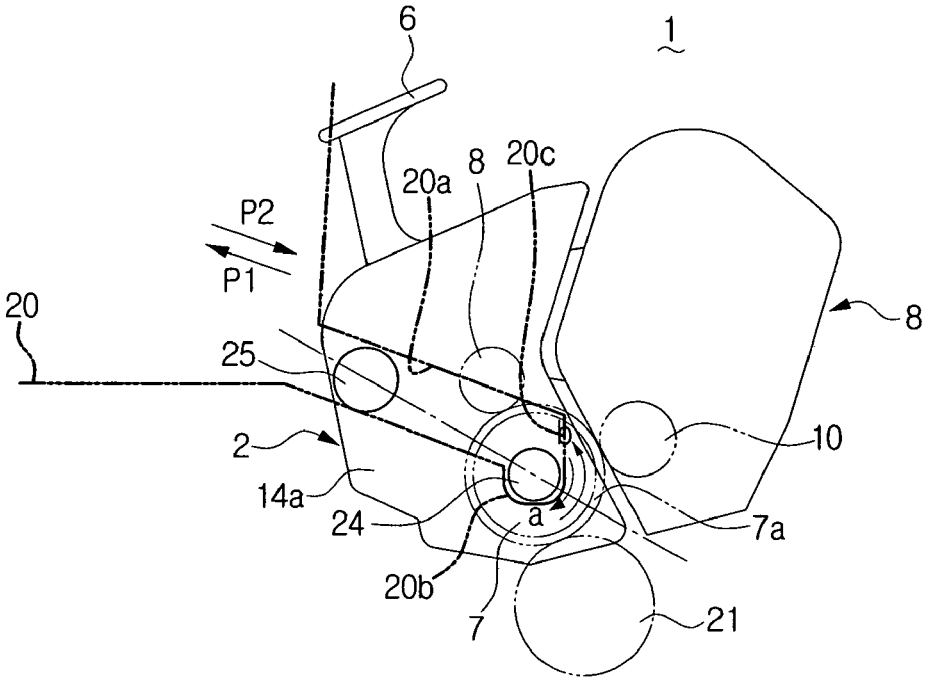
FIG. 2A (PRIOR ART)
FIGS. 2A and 2B are side views of the process cartridge of FIG. 1.
Figure 2B:
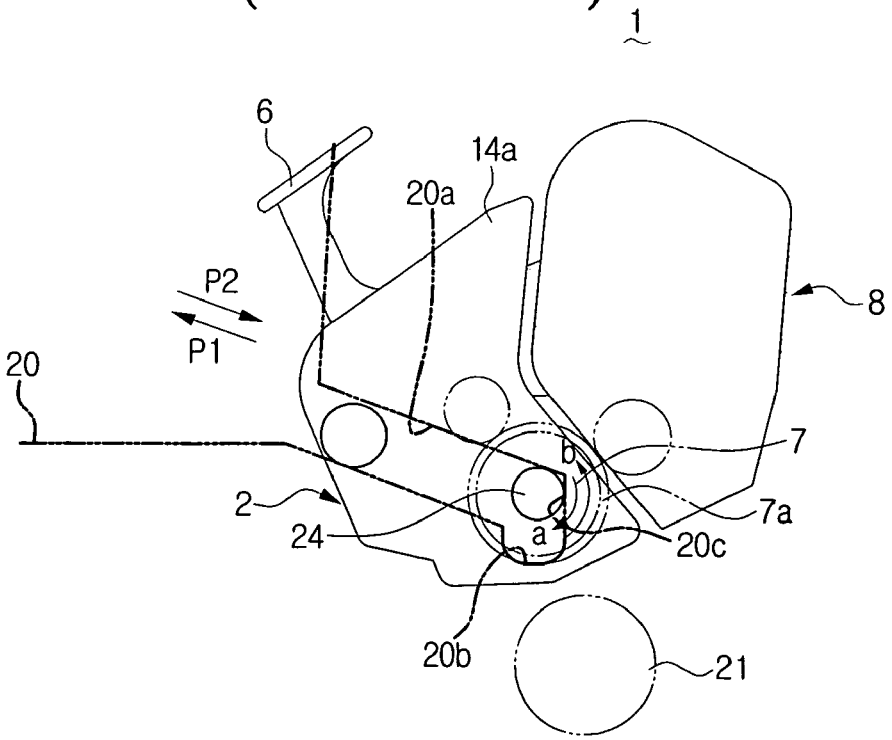
FIG. 2B (PRIOR ART)

A process cartridge according to exemplary embodiments of the present invention, an image forming apparatus having the process cartridge, and a method for mounting and dismounting the process cartridge in or from an image forming apparatus body will be described in detail with reference to the annexed drawings. In the drawings, the same elements are denoted by the same reference numerals throughout the drawings. In the following description, detailed descriptions of known functions and configurations incorporated herein have been omitted for conciseness and clarity.

Figure 3:
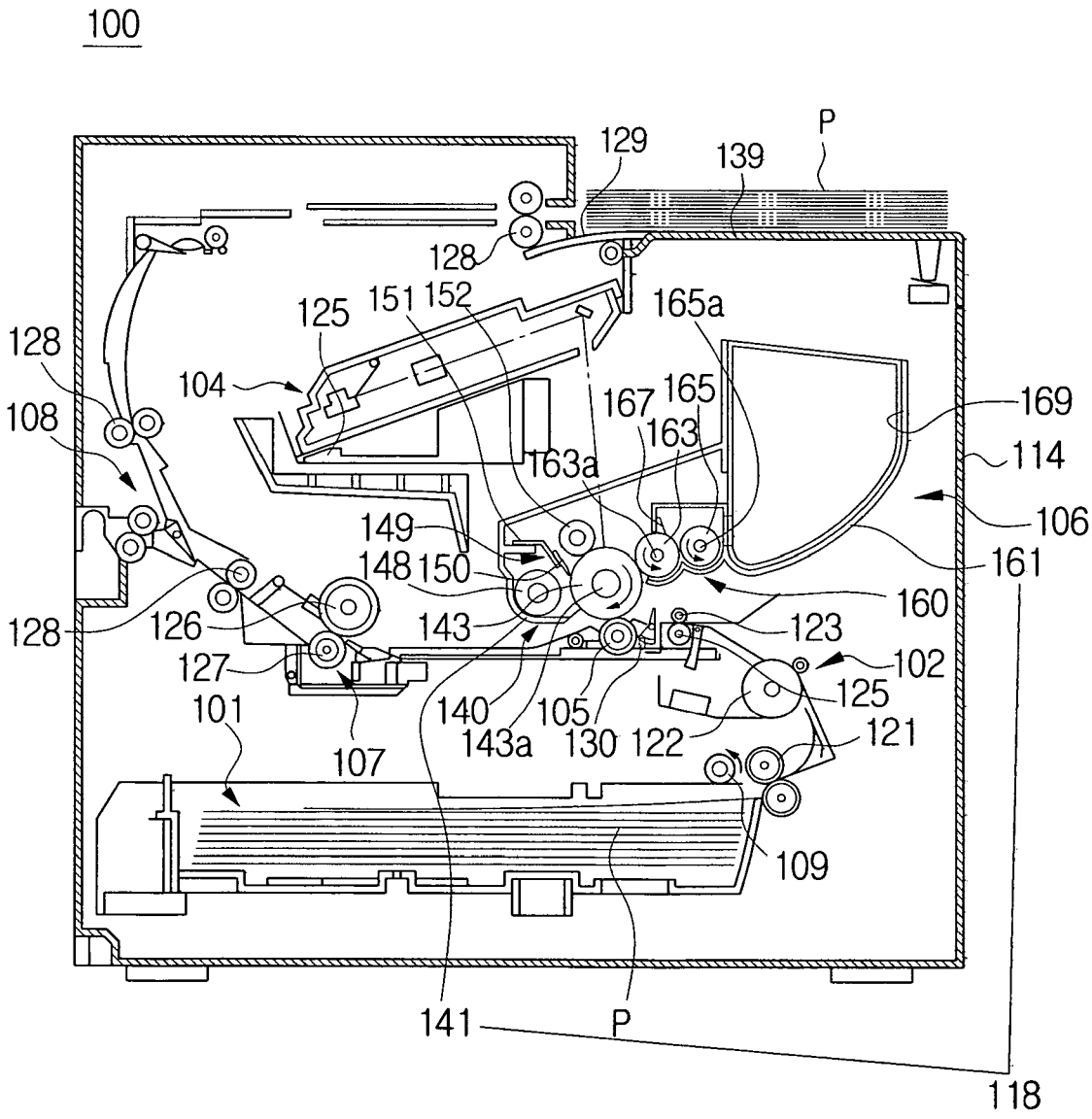
FIG. 3 is a schematic view of a laser printer using a process cartridge according to an embodiment of the present invention.

FIG. 3 is a schematic view of an image forming apparatus having a process cartridge according to an exemplary embodiment of the present invention.

The image forming apparatus according to an embodiment of the present invention is a laser printer 100 that prints and outputs data being input from an external device such as a personal computer (PC).

The laser printer 100 comprises a stacking unit 101 for stacking papers P, a feeding unit 102 for feeding the paper P from the stacking unit 101, a process cartridge 106 forming a developer image on the paper P fed by the feeding unit 102, a fixing unit 107 for fixing the developer image on the paper P with regular heat and pressure, and a discharge unit 108 for discharging the paper P fixed with the developer image.

The stacking unit 101 comprises a paper feeding cassette which has a paper press board elastically supported by an elastic spring to elastically lift and lower the paper P.

The feeding unit 102 comprises a pick-up roller 109 for feeding the paper P by a sheet from the stacking unit 101, first and second feeding rollers 121, 122 for feeding the paper P fed from the pick-up roller 109, and a register and back-up rollers 123, 125 for aligning a leading end of the paper P fed from the first and the second feeding rollers 121, 122.

A paper sensor 130 is disposed at a rear side downstream in a paper feeding path of the register roller 123 to sense a position of the leading end of the paper P.

The process cartridge 106 comprises a photosensitive body unit 140, a developing unit 160, and a housing 118 integrally forming the photosensitive body unit 140 and the developing unit 160 into a single module to detachably mount the photosensitive body unit 140 and the developing unit 160 in the image forming apparatus body 114.

The photosensitive body unit 140 comprises a photosensitive body 143, and has opposite ends rotatably supported by a photosensitive body casing 141. The photosensitive body 143 comprises an organic photoconductive (OPC) drum.

A photosensitive body gear (not shown) is formed at one side of a photosensitive body shaft 143*a* in the photosensitive body casing 141. The photosensitive body gear is meshed with a driving gear (not shown) of a main gear train (not shown) receiving a driving force from a driving motor (not shown) provided in an image forming apparatus body 114 as the process cartridge 104 is mounted to a main body frame 160 (refer to FIG. 5) of the image forming apparatus body 114.

The construction of the main gear train is the same as the generally well-known one, and therefore, the detailed description thereof will be omitted for the sake of brevity.

Referring back to FIG. 3, a charge eraser 148, a photosensitive body cleaner 149, and a charger 152 are arranged along the rotating direction of the photosensitive body 143 to be adjacent to an outer circumference of the photosensitive body 143.

The charge eraser 148, for removing the potential charged on the photosensitive body 143, comprises a charge erasing lamp.

The photosensitive body cleaner 149 is provided for removing waste developer remaining on the surface of the photosensitive body 143 of the developing unit 160. The body cleaner 149 includes a cleaning member 150 such as a cleaning blade, to remove residual toner from the body 143 after the developer image is transferred onto a paper P by a transfer roller 105, comprising a cleaning member 150 such as a cleaning blade.

The cleaning member 150 is attached to a fixing bracket 151 formed in the photosensitive body casing 141 to contact the photosensitive body 143 with a certain pressure.

The charger 152 comprises a charging roller disposed to contact the surface of the photosensitive body 143, and a certain charge bias power is supplied by a charge bias power part (not shown) so as to form a certain charge potential on the surface of the photosensitive body 143.

The developing unit 160 comprises a developing roller 163 arranged opposite the photosensitive body 143 with a certain gap in a developing casing 161. A developing unit also includes supply roller 165 for supplying developer to the developing roller 163, a developer regulating blade 167 for regulating a thickness of developer layer adhered on the developing roller 163, and a developer storage part 169 for storing the developer.

The developing roller 163 attaches the developer to an electrostatic latent image, formed on the photosensitive body 143 by a laser scanning unit (LSU) 104, to develop the latent image. The LSU 104 will be explained later, and the developing roller 163 is opposed to the photosensitive body 143 by a certain gap. The developing bias power part (not shown) supplies a certain developing bias power to the developing roller 163 that is lower than that supplied to the supply roller 165.

The supply roller 165, supplying the developer to the developing roller 163 by using the potential difference between the supply roller 165 and the developing roller 163, is arranged to contact one side of the developing roller 163 and form a nip. The developer is conveyed to a lower space between the supply roller 165 and the developing roller 163 by the supply roller 165 in the developing casing 161.

The developer supply bias power part (not shown) supplies a certain developer supply bias power to the supply roller 165 higher than that to the developing roller 163. Accordingly, the developer of the lower space between the supply roller 165 and the developing roller 163 is charged by the supply roller 165, and attaches to the developing roller 163 with a relatively lower potential and moves to the nip between the supply roller 165 and the developing roller 163.

The developer regulating blade 167 regulates the thickness of the layer of the developer to form a thin layer a predetermined thickness. The developer is supplied to the developing roller 163 through the supply roller 165.

The developer storage part 169 receives and stores the developer and is detachably provided in the developing casing 161. In the developer storage part 169, an agitator (not shown) is arranged to agitate the stored developer. The construction of the agitator is the same as the general one, and therefore, the detailed description thereof will be omitted for the sake of brevity.

Figure 4A:
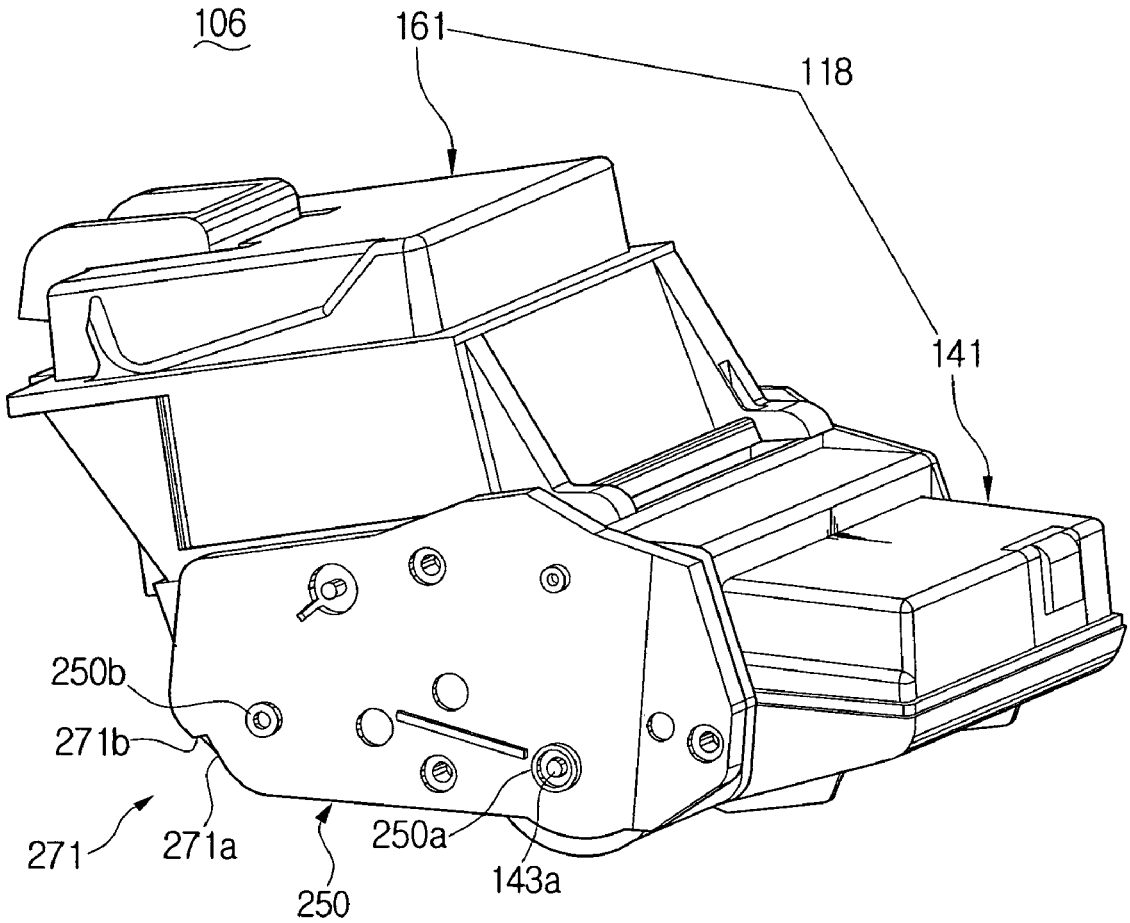
FIGS. 4A through 4C are perspective views of a process cartridge of the laser printer of FIG. 3.
Figure 4B:
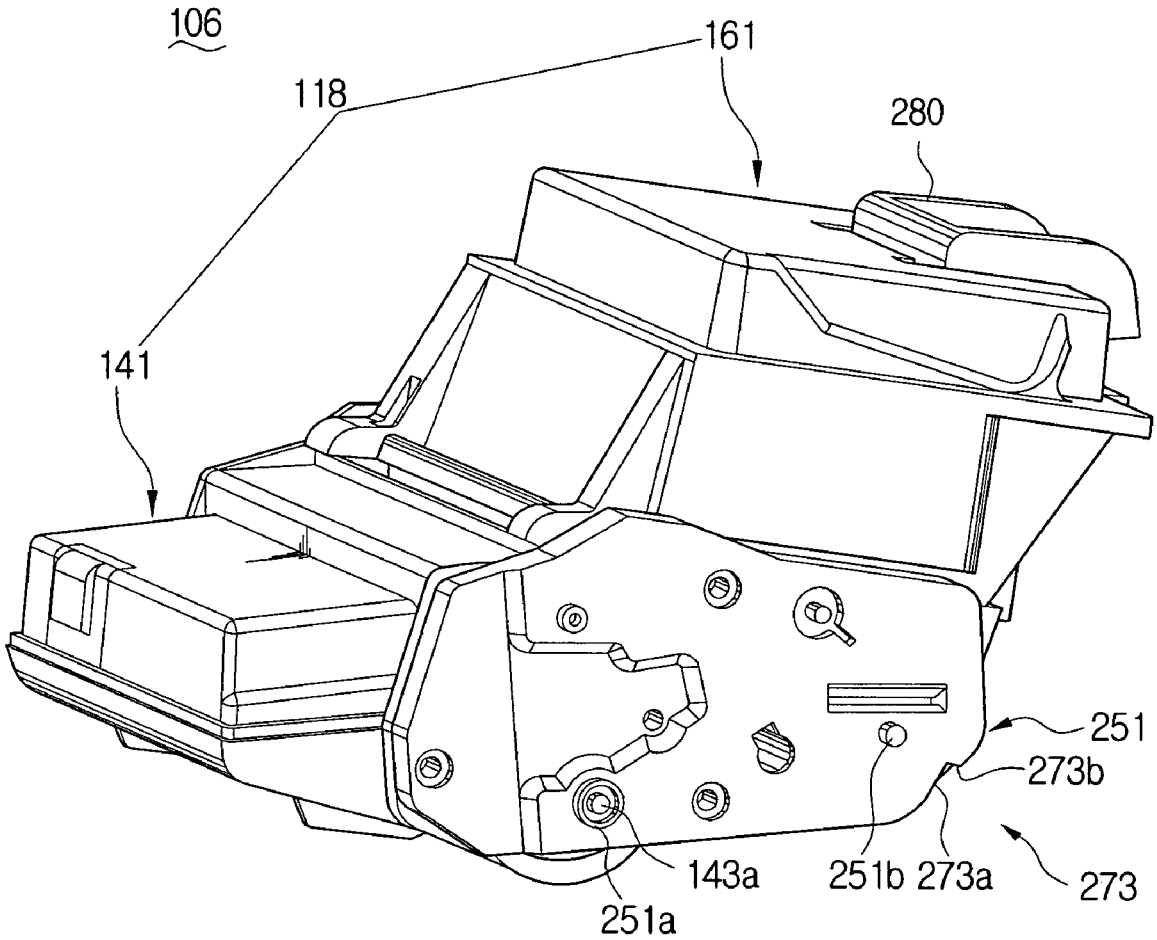
Figure 4C:
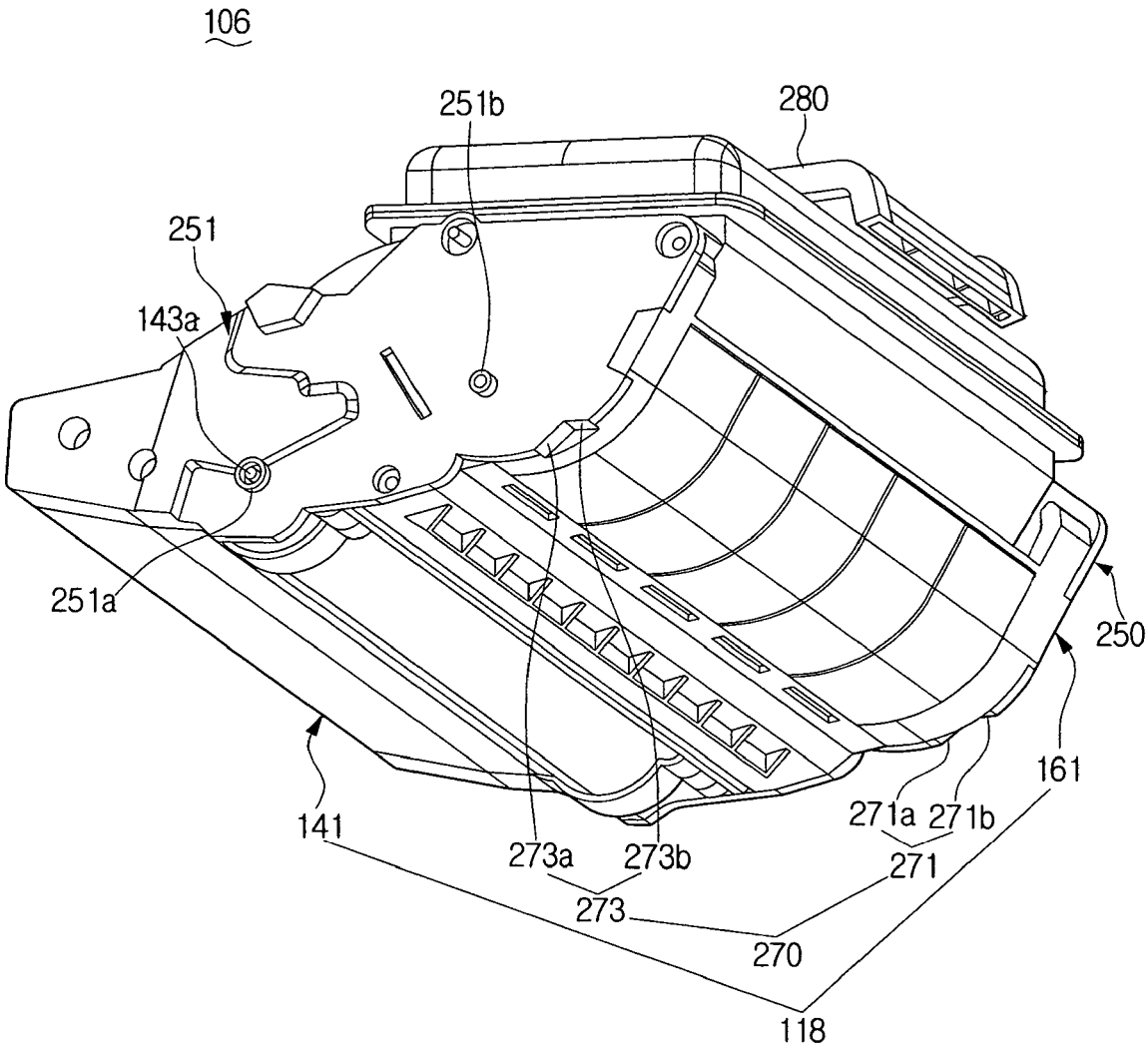

As shown in FIGS. 4A through 4C, the housing 118 comprises a first and a second side plate 250, 251 engaged with opposite ends of the photosensitive body casing 141 and the developing casing 161. The housing 118 supports opposite ends of shafts of various rollers such as the photosensitive body 143, the charging roller, the developing roller 163, and supply roller 165. The first and the second side plates 250, 251 form a first and a second surfaces of the housing 118.

A first and a second guide protrusion 250*a*, 251*a* are formed on the external surface of the first and the second side plates 250, 251 to guide the movement of the housing 118 and position the housing 118 in the mounted position as the process cartridge 106 is mounted and dismounted in or from the main body frame 160.

The first and the second guide protrusions 250*a*, 251*a* protrudes from the external surface of the first and the second side plates 250, 251 to enclose the photosensitive body shaft 143*a* and correspond to the photosensitive body shaft 143*a* in the configuration.

As the process cartridge 106 is mounted and dismounted in or from the main body frame 160, the first and the second guide protrusions 250*a*, 251*a* are guided along a first and a second guide rails 261*a*, 262*a* of a cartridge mount part 261 and received in receiving recesses 261*b*, 262*b* so as to position the housing 118 in the mounted position. The cartridge mount part 261 will be explained later with reference to FIGS. 5 and 6.

Optionally, a third and a fourth guide protrusions 250*b*, 251*b* may be further formed on the external surface of the first and the second side plates 250, 251 so that the housing 118 is guided along the first and the second guide rails 261*a*, 262*a* of the main body frame 160 as the process cartridge 106 is mounted and dismounted in or from the main body frame 160 of the image forming apparatus body 114.

The third and the fourth guide protrusions 250*b*, 251*b* protrude from the external surface of the first and the second side plates 250, 251 by a certain distance from the first and the second guide protrusions 250*a*, 251*a*.

As shown in FIGS. 4A through 4C, a cartridge mount and dismount supporting part 270 is formed on the lower portion surface of the first and the second side plates 250, 251 adjacent to the developing casing 161 to be supported by an image forming apparatus body mount and dismount supporting part 290 and to cooperate with the image forming apparatus body mount and dismount supporting part 290. The lower portion surface of the first and the second side plates 250, 251 forms a third surface of the housing 118 perpendicular to the exterior surface of the first and the second side plates 250, 251.

In cooperation with the main body mount and dismount supporting part 290, the cartridge mount and dismount supporting part 270 operates as a hinge point for rotating the housing 118, as the process cartridge 106 is mounted in or dismounted from the main body frame 160.

The cartridge mount and dismount supporting part 270 comprises first and second hinge recesses 271, 273 formed on a lower portion surface to be adjacent to the edge of the lower portion of the exterior surface of the first and the second side plates 250, 251.

The first and the second hinge recesses 271, 273 comprises an inclined recess surface 271*a*, 273*a* and a horizontal recess surface 271*b*, 273*b*. The inclined recess surfaces 271*a*, 273*a* allow horizontal surfaces 291*b*, 293*b* of first and second hinge protrusions 291, 293 of the main body mount and dismount supporting part 290 to slidingly move or move without contact. The horizontal recess surface 271*b*, 273*b* are meshed with the horizontal surface 291*b*, 293*b* of the first and the second hinge protrusions 291, 293.

As described above, the cartridge mount and dismount supporting part 270 is formed adjacent to the developing casing 161 on the bottom surface of the first and the second side plates 250, 251, where the center of gravity of the process cartridge 106 is located. Therefore, a knob 280 can easily rotate the process cartridge 106 by a relatively small force as the process cartridge 106 is mounted in or dismounted from the image forming apparatus body. The knob 280 will be explained later.

The knob 280 is formed at one side of the upper portion of the developing casing 161 of the housing 118 to carry and move the process cartridge 106. The knob 280 is upwardly and downwardly movable.

In the present embodiment, the knob 280 is formed at one side of the upper portion of the developing casing 161; however, this should not be considered as limiting. The knob 280 may be formed at another position in which the process cartridge 106 can be rotated by the knob 280 around the cartridge mount and dismount supporting part 270 functioning as a hinge point as the process cartridge 106 is mounted in or dismounted from the image forming apparatus body. For example, the knob may be formed on a proper position above a line connecting the first or the second guide protrusion 250*a*, 251*a* and the cartridge mount and dismount supporting part 270.

Figure 5:
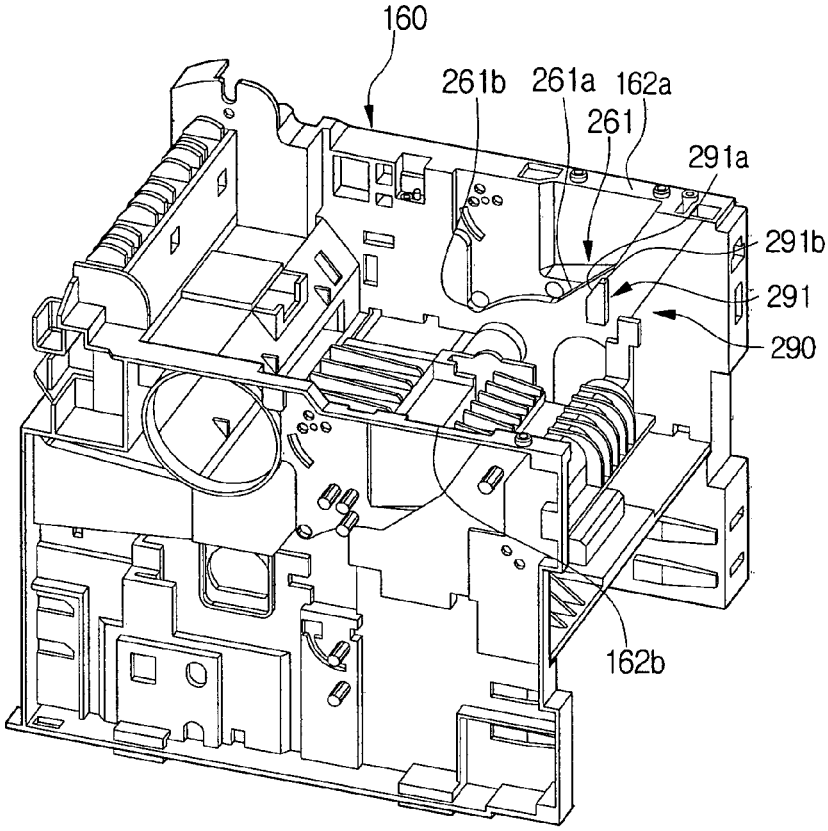
FIG. 5 is a perspective view of a main body frame of the laser printer of FIG. 3.
Figure 6:
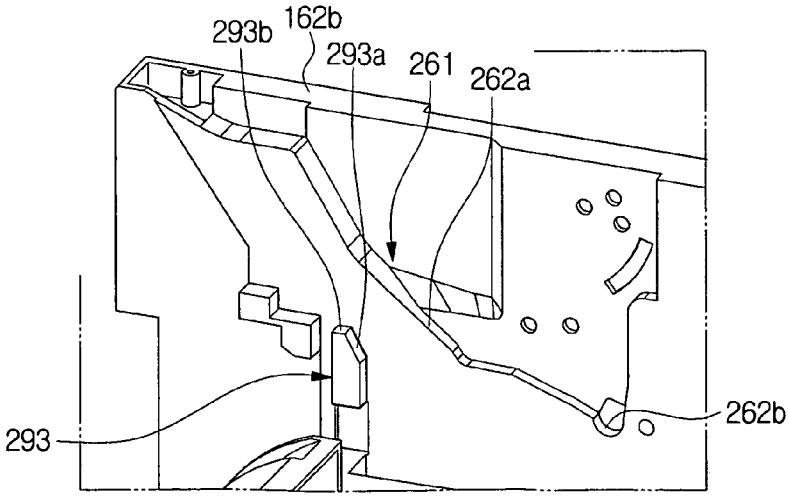
FIG. 6 is a perspective view of a cartridge mounting part and a laser printer main body mount and dismount supporting part of the laser printer main body frame of FIG. 5.

As shown in FIGS. 5 and 6, the cartridge mount part 261 is formed on the main body frame 160 to mount the process cartridge 106.

The cartridge mount part 261 comprises the first and the second guide rails 261*a*, 262*a* formed at upper portions of inner surfaces of a first and a second vertical wall 162*a*, 162*b*. The first and the second guide rails 261*a*, 262*a* are inclined by certain angles and have curved surfaces with opened top portions so that the first through the fourth guide protrusions 250*a*, 251*a*, 250*b*, 251*b* of the process cartridge 106 can be easily moved therein.

The first and the second guide rails 261*a*, 262*a* comprise the receiving recesses 261*b*, 262*b* to receive the first and the second guide protrusions 250*a*, 251*a*. The receiving recesses 261*b*, 262*b* may be semi-circular.

The main body mount and dismount supporting part 290 is formed on the inner surface of the first and the second vertical walls 162*a*, 162*b* under the first and the second guide rails 261*a*, 262*a* to support the cartridge mount and dismount supporting part 270 so that the housing 118 can be rotated as the process cartridge 106 is mounted in or dismounted from the image forming apparatus body.

The main body mount and dismount supporting part 290 comprises the first and the second hinge protrusions 291, 293 corresponding to the first and the second hinge recesses 271, 273 of the cartridge mount and dismount part 270.

The first and the second hinge protrusions 291, 293 comprise a cutting surface or an inclined surface 291*a*, 293*a*, which are cut so that the surfaces do not contact the housing 118 as the process cartridge 106 is mounted in or dismounted from the image forming apparatus body. Horizontal surfaces 291*b*, 293*b* mesh with the horizontal recess surfaces 271*b*, 273*b* of the first and the second hinge recesses 271, 273 to form a hinge point supporting the rotation of the housing 118.

The process of mounting and dismounting the process cartridge 106 in or from the cartridge mount part 261 of the main body frame 160 will be explained with reference to FIGS. 7A through 8B as below.

Firstly, the main body cover 139 is opened, and the knob 280 of the process cartridge 106 is grasped by a user.

Figure 7A:
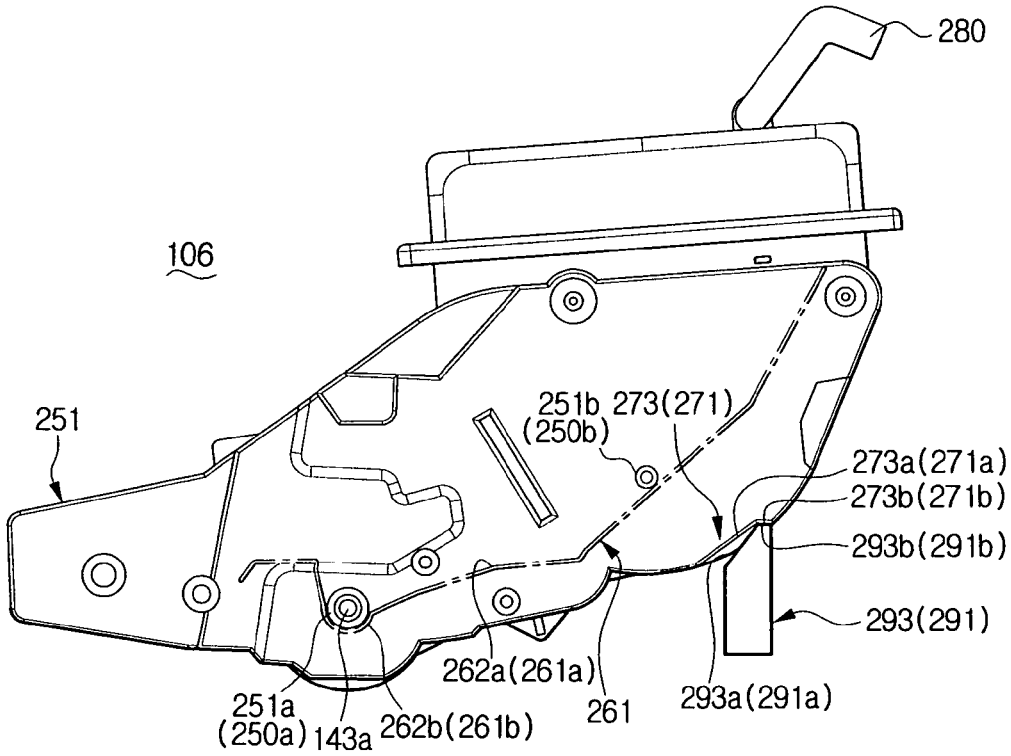
FIGS. 7A through 7C are side views of an example of a process of dismounting a process cartridge from the main body frame of the laser printer of FIG. 5.
Figure 7B:
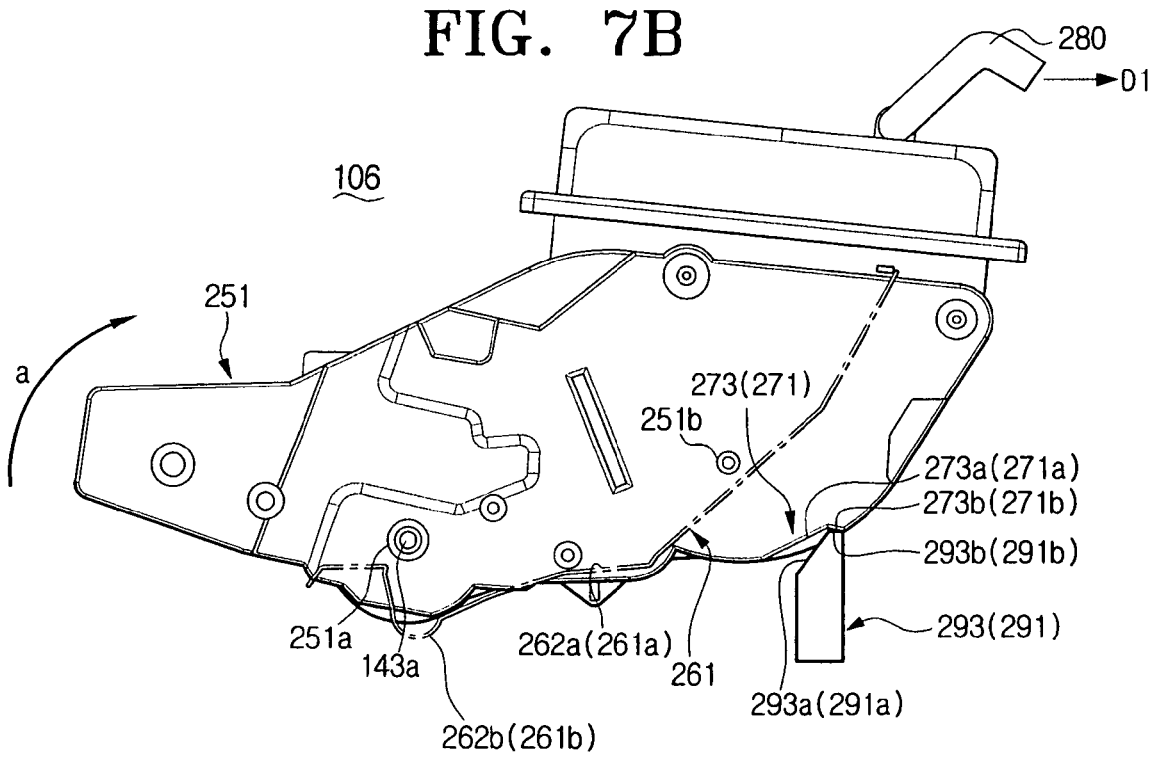

As shown in FIG. 7B, the process cartridge 106 is pulled in a substantially horizontal direction D1 by the knob 280.

As a result, the first and the second hinge recesses 271, 273 of the cartridge mount and dismount supporting part 270 are supported by the first and the second hinge protrusions 291, 293 of the main body mount and dismount supporting part 290 so that the process cartridge 106 is rotated in the direction of arrow a based on the contacting point, as a hinge point, between the first and the second hinge recesses 271, 273 and the first and the second hinge protrusions 291, 293. The first and the second guide protrusions 250*a*, 251*a* received in the receiving recesses 261*b*, 262*b* of the first and the second guide rails 261*a*, 262*a*, are separated from the receiving recesses 261*b*, 262*b*.

Figure 7C:
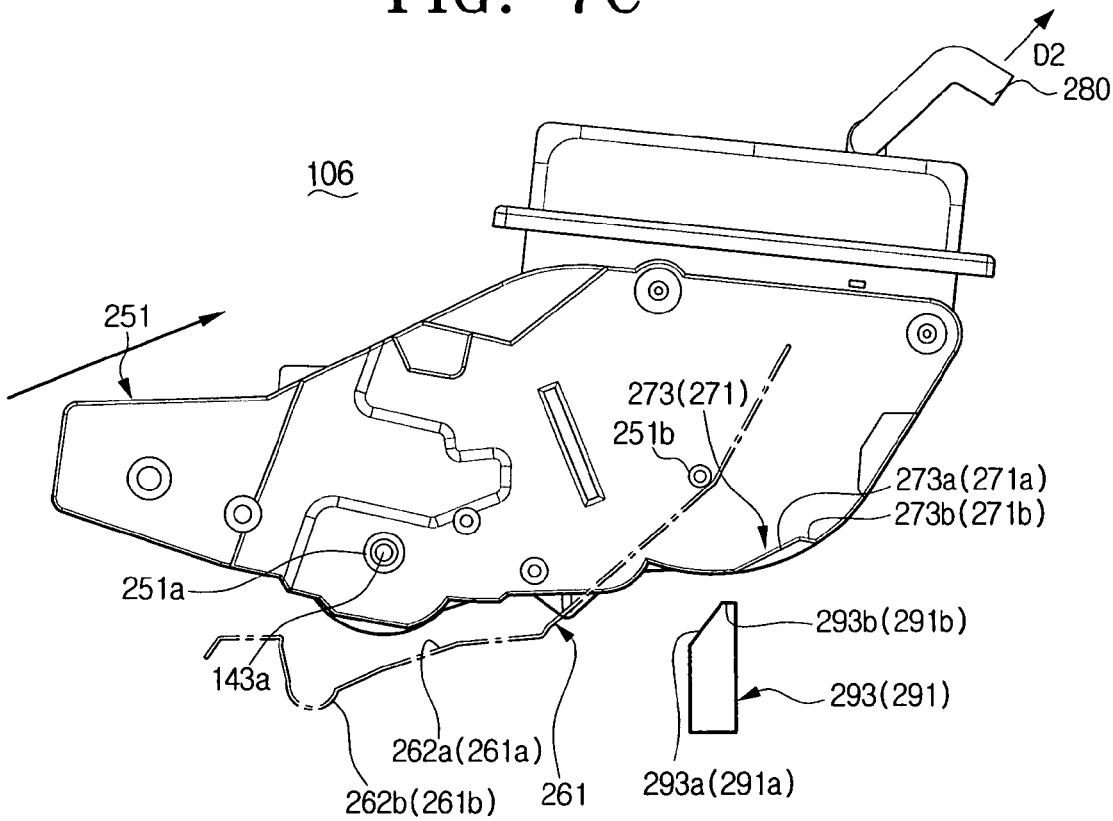

As shown in FIG. 7C, the process cartridge 106 is lifted in the first direction D2 by the knob 280 so that the guide protrusions 250*a*, 251*a*, 250*b*, 251*b* can be separated from the first and the second guide rails 261*a*, 262*a*. Then, the process cartridge 106 is pulled out through the opening opened by the main body cover 139.

After being pulled out, the process cartridge 106 is disassembled to repair problematic parts thereof or replaced with new one, if necessary.

After the repair or replacement is completed, the repaired or replaced process cartridge 106 is grasped by the knob 280 to be put into the main body 114 again through the opening opened by the main body cover 139.

Figure 8A:
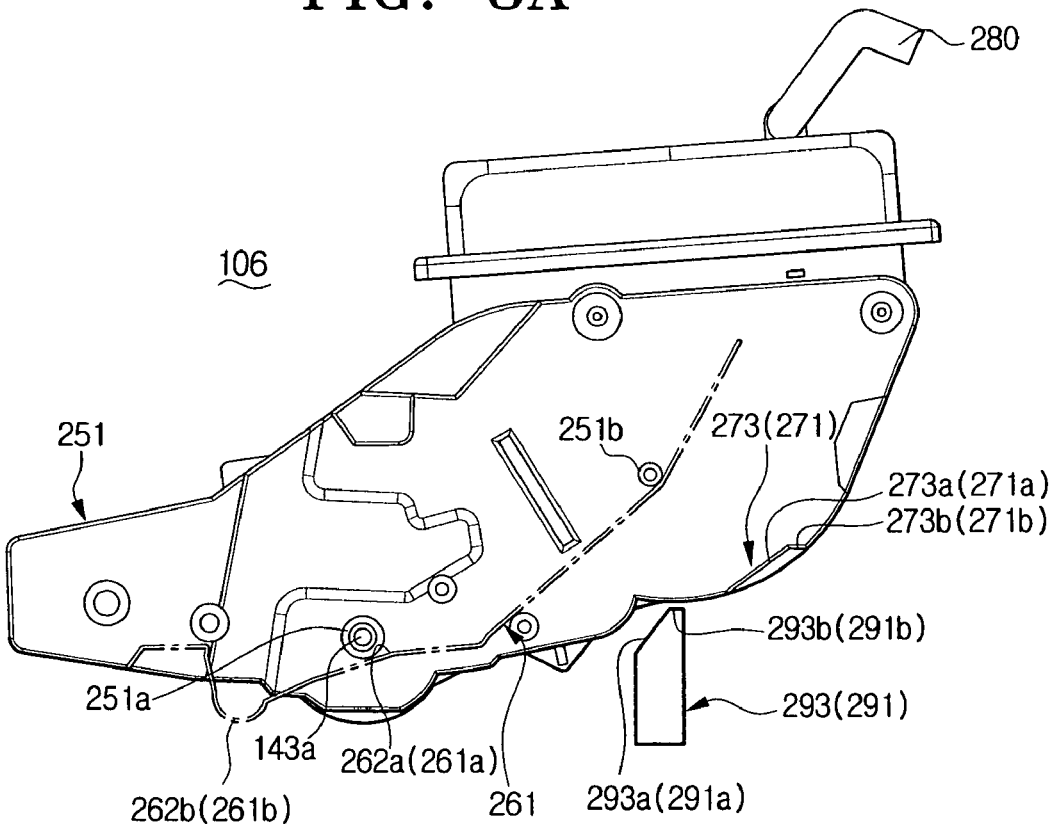
FIGS. 8A and 8B are side views of an example of a process of mounting a process cartridge in the main body frame of the laser printer of FIG. 5.

As shown in FIG. 8A, the process cartridge 106 is positioned such that the first through the fourth guide protrusions 250*a*, 251*a*, 250*b*, 251*b* are placed on the first and the second guide rails 261*a*, 262*a* of the cartridge mount part 261.

Figure 8B:
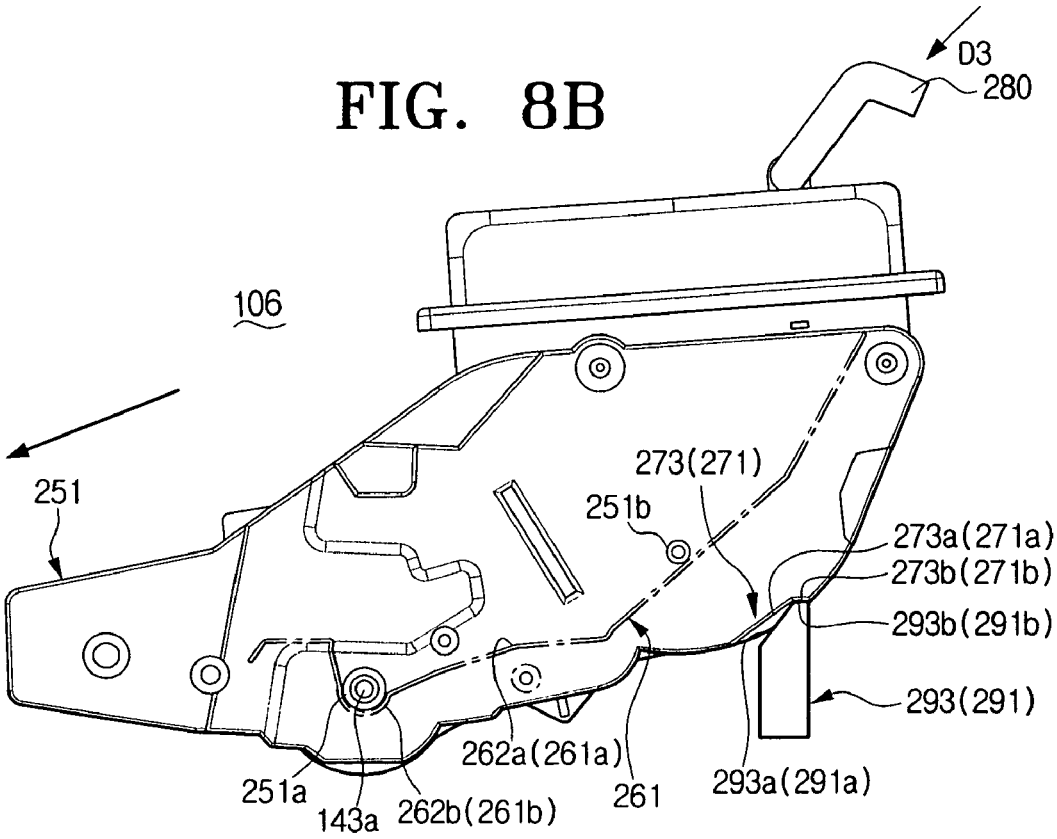

As a result, the first through the fourth guide protrusions 250*a*, 251*a*, 250*b*, 251*b* slide along the first and the second guide rails 261*a*, 262*a* by the weight of the process cartridge 106 such that the process cartridge 106 is lowered in the second direction D3 (refer to FIG. 8B).

Then, as the first and the second guide protrusions 250*a*, 251*a* are received into the receiving recesses 261*b*, 262*b* of the first and the second guide rails 261*a*, 262*a* and the first and the second hinge recesses 271, 273 of the cartridge mount and dismount supporting part 270 receive the first and the second hinge protrusions 291, 293 of the main body mount and dismount supporting part 290 as shown in FIG. 8B, the process cartridge 106 is stopped from moving in the second direction D3, and the process for mounting the process cartridge 106 is completed. At this time, the photosensitive body gear of one end of the photosensitive body shaft 143*a* is meshed with the driving gear of the main gear train of the main body 114 transmitting the driving force of the driving motor.

Referring back to FIG. 4, the LSU 104 is fixed at a fixing bracket 125 above the process cartridge 106. The LSU 104 emits a laser beam onto the surface of the photosensitive body 143, charged with a certain potential by the charger 152, by using a laser diode according to image signals input from an external device such as a personal computer. Therefore, an electrostatic latent image can be formed which has a certain potential lower than a charged potential.

The transfer roller 105 is arranged under the photosensitive body 143 of the process cartridge 106.

The transfer roller 105, for transferring the developer image formed on the photosensitive body 143 onto the paper P, is arranged to pressurize the photosensitive body 143 with a certain pressure. A certain transfer bias power is supplied to the transfer roller 105 by the transfer bias power part (not shown) so that the developer image formed on the photosensitive body 143 can be transferred onto the paper P.

The fixing part 107 comprises a heating roller 126 for heating the developer image that was transferred from the photosensitive body 143 onto the paper P by the transfer roller 105, and a press roller 127 for pressing the developer image.

The discharge unit 108 comprises a discharge roller 128 for discharging the printed paper P, and a stack 129 for stacking and supporting the discharged paper P.

As described above, the process cartridge 106 and the laser printer 100 having the process cartridge according to an embodiment of the present invention can guide the mounting of the housing 118 and position the housing 118 in a mounting position only by using the first and the second guide protrusions 250*a*, 251*a*, as the process cartridge 106 is mounted in or dismounted from the main body frame 160. Therefore, the process cartridge 106 can have a simpler structure and can be easily mounted in or dismounted from the image forming apparatus in comparison with the conventional process cartridge 1.

The process cartridge 106 and the laser printer 100 having the process cartridge according to an embodiment of the present invention includes the cartridge mount and dismount supporting part 270 which is formed on the bottom surface of the first and the second side plate 250, 251 of the housing 118 and has the most efficient movement of the knob 280 so that the process cartridge 106 can be easily and efficiently mounted in or dismounted from the image forming apparatus by the knob 280.

The process cartridge 106 and the laser printer 100 having the process cartridge according to an embodiment of the present invention includes the guide rails 261*a*, 262*a* with opened top portion, instead of including the guide recess 20*a* guiding the guide protrusions 24, 25 as the conventional process cartridge 1, so as to be easily manufactured and have simpler structure. Additionally, the guide protrusions 24, 25 are not required to fit in the guide recess 20*a* to mount and dismount the process cartridge 106 in or from the main body frame 160. Therefore, the time required to mount and dismount the process cartridge 106 in or from the main body frame 160 can be significantly shortened. Although the process cartridge 106 is pulled out by force, the first and the second guide protrusions 250*a*, 251*a* and/or the third and the fourth guide protrusions 250*b*, 251*b* are not damaged.

According to an embodiment of the present invention, the process cartridge and the image forming apparatus having the same are applied to the process cartridge 106 and the laser printer 100 having the process cartridge. The process cartridge 106 comprises the photosensitive body unit 140, the developing unit 160, and the housing 118 integrally forming the photosensitive body unit 140 and the developing unit 160 into a single module to be detachably mounted in or dismounted from the image forming apparatus main body 114. However, this should not be considered as limiting. The process cartridge according to an embodiment of the present invention and the image forming apparatus having the process cartridge may be applied to a process cartridge (not shown) such as a developing cartridge comprising a developing unit, which includes a developing roller without a photosensitive body unit, and a housing, and to an image forming apparatus comprising one photosensitive body and a plurality of developing cartridges.

The operation of the laser printer 100 having the process cartridge 106 according to an embodiment of the present invention will be in detail explained with reference to FIG. 3.

As a print command on a document is input from the external device such as personal computer, a control part (not shown) of the printer 100 drives the pick-up roller 109 so that the uppermost paper P in the stack unit 101 is picked up by the pick-up roller 109 and fed to the register roller 123 by the first and the second feeding rollers 121, 122.

The leading end of the paper P is fed to the register roller 124 and pressed and aligned by the nip between the register roller 123 and the back up roller 125.

Then, as the paper P passes the nip between the register roller 123 and the back up roller 125 and continues to move, the leading end of the paper P actuates the paper sensor 130 between the register roller 123 and the transfer roller 105, and the paper sensor 130 sends a paper sensing signal to the control part.

The control part counts the moving time of paper P from the paper sensor 130 to the transfer roller 105 according to the paper sensing signal, and after feeding the paper P during the preset required time arriving at the printing start position, operates the process cartridge 106 and the transfer roller 105.

While the paper P is fed to the printing start position, an electrostatic latent image is formed on the photosensitive body 143 of the process cartridge 106 by the laser beam emitted from the LSU 104 according to the image signal. The electrostatic latent image formed on the photosensitive body 143 is developed into a visible developer image by the developing roller 163.

Then, as the paper P arrives at the photosensitive body 143 of the process cartridge 106, the developer image formed on the photosensitive body 143 is transferred onto the paper P by the transfer roller 105 under the control of the control part.

Passing the fixing unit 107, the developer image transferred onto the paper P is fixed on the paper P by the heat and pressure of the heating roller 126 and the press roller 127. The paper P fixed with the developer image is discharged to the stack 129 by the discharge roller 128 of the discharge unit 108.

Then, the operations of picking up, developing, fixing and discharging the paper P are repeated according to the aforementioned method until all contents of the document are printed.

As described above, the process cartridge according to an embodiment of the present invention, the image forming apparatus having the cartridge, and the method for mounting and dismounting the process cartridge in and from the image forming apparatus can guide the mounting of the housing and position the housing in a mounting position only by using the first and the second guide protrusions as the process cartridge is mounted in or dismounted from the main body frame. Therefore, the process cartridge can have a simpler structure and can be easily mounted in or dismounted from the image forming apparatus in comparison with the conventional process cartridge.

The process cartridge according to an embodiment of the present invention and the image forming apparatus having the cartridge, and the method for mounting and dismounting the process cartridge in and from the image forming apparatus includes the cartridge mount and dismount supporting part which is formed on the bottom surface of the first and the second side plate of the housing and has the most efficient movement by the knob so that the process cartridge can be easily and efficiently mounted in or dismounted from the image forming apparatus by the knob.

The process cartridge according to an embodiment of the present invention and the image forming apparatus having the same, and the method for mounting and dismounting the process cartridge in and from the image forming apparatus includes the guide rails with opened top portion, instead of including the guide recess guiding the guide protrusions as the conventional process cartridge, so as to be easily manufactured and have a simpler structure. Additionally, the guide protrusions are not required to fit in the guide recess to mount and dismount the process cartridge in or from the main body frame. Therefore, the time required to mount and dismount the process cartridge in or from the main body frame can be significantly shortened. Although the process cartridge is pulled out by force, the guide protrusions are not damaged.

While the invention has been shown and described with reference to certain embodiments thereof, it will be understood by those skilled in the art that various changes in form and details may be made therein without departing from the spirit and scope of the invention as defined by the appended claims.

What is claimed is:

1. A process cartridge of an image forming apparatus, which can be detachably mounted in an image forming apparatus body, the process cartridge comprising:

at least one photosensitive body on which an electrostatic latent image is formed, and a developing member for developing the electrostatic latent image; and a housing receiving and supporting the at least one photosensitive body and the developing member, wherein the housing comprises, first and second guide protrusions outwardly protruding respectively from a first surface and a second surface opposite the first surface of the housing in order to position the housing in a mounting position as the process cartridge is mounted in the image forming apparatus body, and the first and second guide protrusions formed perpendicular to a direction in which the process cartridge is mounted in the image forming apparatus body, and form guide members for guiding the housing into the mounting position, and a mount and dismount supporting part formed on a bottom surface of the housing, perpendicular to the first and the second surfaces of the housing in order to support rotation of the housing as the process cartridge is mounted in or dismounted from the image forming apparatus body.

2. The process cartridge as claimed in claim 1, wherein the first and the second guide protrusions are coaxially formed with an axis of one of the photosensitive body or the developing member.

3. The process cartridge as claimed in claim 1, wherein the mount and dismount supporting part comprises at least one hinge recess defining a pivot point and being formed on the bottom surface to be adjacent to an edge of at least one of the first and the second surfaces.

4. The process cartridge as claimed in claim 3, wherein the at least one hinge recess comprises first and second hinge recesses which are formed at the bottom portion surface of first and second side plates at opposite ends of the housing, the first and second recesses including an inclined recess surface and a horizontal recess surface.

5. The process cartridge as claimed in claim 1, wherein the housing further comprises a knob formed above a line connecting the first or the second guide protrusion and the mount and dismount supporting part.

6. The process cartridge as claimed in claim 1, wherein the housing further comprises at least one third and at least one fourth guide protrusions protruding outwardly from the first and the second surfaces a certain distance from the first and the second guide protrusions in order to guide movement of the housing as the process cartridge is mounted in or dismounted from the image forming apparatus body.

7. An image forming apparatus comprising:

a process cartridge including at least one photosensitive body on which an electrostatic latent image is formed, and a developing member for developing the electrostatic latent image, and a housing receiving and supporting the at least one photosensitive body and the developing member; and a main body frame including a cartridge mount part having first and second guide rails with an opened top portion to mount the process cartridge, and a main body mount and dismount supporting part supporting rotation of a bottom surface of the process cartridge as the process cartridge is mounted in or dismounted from the image forming apparatus, wherein the housing comprises, first and second guide protrusions respectively protruding outwardly from a first surface and a second surface opposite the first surface of the housing to an outside and being guided along the first and the second guide rails, respectively, in order to position the housing in a mounting position as the process cartridge is mounted in the image forming apparatus, the first and second guide protrusions being formed perpendicular to a direction in which the process cartridge is mounted in a cartridge mount part, and a cartridge mount and dismount supporting part formed on the bottom surface of the process cartridge, perpendicular to the first and the second surfaces, of the housing to cooperate with the main body mount and dismount supporting part in order to support rotation of the housing in cooperation with the main body mount and dismount supporting part as the process cartridge is mounted in or dismounted from the image forming apparatus.

8. The apparatus as claimed in claim 7, wherein the first and the second guide rails comprise a receiving recess for receiving the first and the second guide protrusions.

9. The apparatus as claimed in claim 7, wherein the first and the second guide protrusions are coaxially formed with an axis of one of the photosensitive body or the developing member.

10. The apparatus as claimed in claim 7, wherein the cartridge mount and dismount supporting part comprises at least one hinge recess formed on the lower surface to be adjacent to an edge of at least one of the first and the second surfaces, and wherein the main body mount and dismount supporting part comprises at least one hinge protrusion formed at the main body frame to cooperate with the hinge recess.

11. The apparatus as claimed in claim 10, wherein the at least one hinge recess comprises first and second hinge recesses formed at the lower portion surface of first and second side plates at opposite ends of the housing, respectively, and include an inclined recess surface and a horizontal recess surface, and wherein the at least one hinge protrusion comprises first and second hinge protrusions formed at the main body frame under the first and the second guide rails and include an inclined surface that does not contact the housing as the process cartridge is mounted in or dismounted from the image forming apparatus and a horizontal surface to mesh with the horizontal recess surface of the second hinge recess.

12. The apparatus as claimed in claim 7, wherein the housing further comprises a knob formed above a line connecting the first or the second guide protrusion and the cartridge mount and dismount supporting part.

13. The apparatus as claimed in claim 7, wherein the housing further comprises at least one third and at least one fourth guide protrusions protruding outwardly from the first and the second surfaces a certain distance from the first and the second guide protrusions in order to guide movement of the housing along the first and the second guide rails as the process cartridge is mounted in or dismounted from the image forming apparatus body.

14. The apparatus of claim 7, wherein the image forming apparatus has an opening for receiving said process cartridge, and where said first and second guide rails extend in a direction substantially perpendicular to said opening and extending between a first end adjacent said opening and second end at a process cartridge mounting position, said first and second guide rails having a recess at said second end for receiving said first and second guide protrusions, and where said main body mount and dismount supporting part is spaced from the first end of said first and second guide rails.

15. A method for mounting and dismounting a process cartridge in and from an image forming apparatus, comprising:

grasping a knob on the process cartridge;

rotating the process cartridge about a pivot point defined by a cartridge mount and dismount supporting part formed on a lewef bottom surface of the process cartridge by pulling the knob to release first and second guide protrusions from the image forming apparatus; and pulling out the process cartridge outwardly from the image forming apparatus.

16. The method as claimed in claim 15, wherein the step of rotating of the process cartridge comprises:

rotating the process cartridge by supporting the cartridge mount and dismount supporting part on a main body mount and dismount supporting part of a main body frame of the image forming apparatus; and separating the first and second guide protrusions on opposite ends of the process cartridge from receiving recesses of a first and a second guide rails of the cartridge mount part of the main body frame.

17. The method as claimed in claim 16, wherein the main body mount and dismount supporting part comprises at least one upwardly extending hinge protrusion formed on the main body frame, and wherein the cartridge mount and dismount supporting part comprise at least one hinge recess formed on the bottom portion of the process cartridge to cooperate with the hinge protrusion.

18. The method as claimed in claim 16, wherein the step of pulling out the process cartridge outwardly further comprises lifting the process cartridge to separate the first and the second guide protrusions of the process cartridge from the first and the second guide rails.

19. The method as claimed in claim 15, further comprising:

locating the process cartridge on a cartridge mount part of a main body frame of the image forming apparatus;

sliding the process cartridge along the cartridge mount part; and supporting the cartridge mount and dismount supporting part of the process cartridge by the main body mount and dismount supporting part of the main body frame.

20. The method as claimed in claim 19, wherein the step of locating the process cartridge on the cartridge mount part comprises locating first and second guide protrusions on opposite ends of the process cartridge on first and second guide rails, respectively, of the main body frame.

21. The method as claimed in claim 20, wherein the step of sliding the process cartridge comprises sliding the first and the second guide protrusions along the first and the second guide rails.

22. The method as claimed in claim 21, further comprising: fitting the first and the second guide protrusions in a receiving recess of the first and the second guide rails.

23. The method as claimed in claim 19, wherein the step of supporting the cartridge mount and dismount supporting part by the main body mount and dismount supporting part comprises fitting a first and a second hinge recesses of the cartridge mount and dismount supporting part of a lower portion surface of the process cartridge over first and second hinge protrusions, corresponding to the main body mount and dismount part of the main body frame.

* * * * *